US005546360A

United States Patent [19]

Deegan

[11] Patent Number: 5,546,360

[45] Date of Patent: Aug. 13, 1996

[54] ELECTRICALLY STEERED ACOUSTIC LENS

[76] Inventor: Thierry Deegan, 39 Porter La., Portsmouth, R.I. 02871

[21] Appl. No.: 337,721

[22] Filed: Nov. 14, 1994

[51] Int. Cl.[6] ..... H04R 23/00; H04R 17/00

[52] U.S. Cl. ..... 367/150; 310/335

[58] Field of Search ..... 367/150; 310/335

[56] References Cited

U.S. PATENT DOCUMENTS

| | | | |
|---|---|---|---|
| 2,913,602 | 11/1959 | Joy | 367/150 |
| 3,531,185 | 9/1970 | Buchsbaum et al. | 350/336 |
| 3,984,086 | 10/1976 | Gerrish | 251/129 |
| 4,014,693 | 3/1977 | Clark | 346/150 |
| 4,037,929 | 7/1977 | Bricot et al. | 350/336 |
| 4,168,482 | 9/1979 | Sternberg | 367/150 |
| 5,018,835 | 5/1991 | Dorschner | 350/336 |
| 5,184,233 | 2/1993 | Lim et al. | 359/46 |
| 5,241,991 | 9/1993 | Iorio et al. | 137/807 |
| 5,288,535 | 2/1994 | Kanbara et al. | 428/68 |

*Primary Examiner*—J. Woodrow Eldred
*Attorney, Agent, or Firm*—Robert J. Doherty

[57] ABSTRACT

This invention is a composite acoustic lens that can be steered internally through electrical control. It can collect and direct acoustic energy from a plane wave to focus it on a transducer. It can also take the nearly omnidirectional output from a standard acoustic transducer and direct its energy in a plane wave. In the receive role the lens increases the effective signal-to-noise ratio of the array; in the transmit role it reduces the output energy that is responsible for reverberation. The lens is steerable by virtue of its material: it is electrorheological. Its bulk modulus, and the resulting speed of sound, can be changed electrically. Controlling the gradient of the index of refraction allows the steering to be adjusted precisely, continuously, and quickly. It is held by a container of plastic material that matches the acoustic impedance of water and minimizes the presence of near-field scatterers. A system based on the proposed lens can improve the effectiveness of both active and passive sonars, reduce the detectability of active transmissions and reduce the inboard footprint. Medical applications exist for both imaging and lithotriptic devices.

7 Claims, 3 Drawing Sheets

ELECTRICALLY STEERED ACOUSTIC LENS

INTRODUCTION

Military sonars and sonic medical imaging systems can be made more effective through the use of acoustic lenses. A lens is a mass of material with a speed of sound that differs from that of the surrounding medium, in this case, water. Acoustic lenses can be used to focus received rays on hydrophones or to control the output from projectors. This concept is not new; wax lenses have been studied and used for acoustic devices for many decades. But fixed blocks of delicate wax are not well suited to the needs of military sonars. Nor can fixed lenses satisfy the needs of multi-beam sonars.

A particular material that has been a laboratory curiosity for some years and is now finding a wide variety of applications can be used for acoustic lensing. It is a class of material called electro-rheological fluid. This material is made of non-conducting fluid such as mineral oil with a suspension of semiconducting particles such as alumino-silicate powder. This fluid has the characteristic that it changes several of its properties with the application of an electric field. The characteristic that has been studied most is a change in viscosity by as much as a factor of 1000. Applicable to the acoustic lens application is the increase in the bulk modulus of the fluid that also occurs when the fluid "solidifies". The speed of sound in a fluid is related to the bulk modulus by $$C=\frac{\sqrt{B}}{d}$$

where c=speed of sound
B=adiabatic bulk modulus
d=mass density.

This equation implies that this class of material can have its speed of sound changed electrically. Controlling the electric field applied to the material adjusts the bulk modulus and the concomitant speed of sound to a desired value.

Lenses and the Index of Refraction

Lenses work by refracting rays with materials of differing speeds of sound. The index of refraction (the ratio of the speed of sound in a material to the speed of sound in water) is an indicator of how much refraction or ray bending can be accomplished. Optical and acoustic lenses in common application use a material with a fixed index of refraction greater than one. That is, the glass or wax used as the lens has a speed of sound greater than that in open air/water. The refraction in these ordinary kinds of lenses occurs at the boundaries between the water and the lens. The degree of refraction is determined by Snell's Law which is expressed $$\frac{\sin a_i}{\sin a_t}=\frac{c_1}{c_2}$$

where $a_i$=angle of the incident ray with respect to the normal of the boundary between material 1 and material 2,
$a_t$=angle of the transmitted ray with respect to the normal of the boundary,
$c_1$=speed of sound in material 1, and
$c_2$=speed of sound in material 2.

In a common glass lens the incident ray is bent at the front and rear faces of the lens according to Snell's Law. The index of refraction of the lens material is constant and higher than that of the surrounding water. Similar lens action can be obtained in a more subtle form of lens that is applicable to the lens concept of this invention. It works by having a variation of propagation speed along the length of the lens block. Incident rays are bent according to the gradient of the index of refraction and the ray path is expressed with the equation that is based on Fermat's principle of least action.

$$n\frac{d^2P}{ds^2}+\left(\nabla n\cdot\frac{dP}{ds}\right)\frac{dP}{ds}=\nabla n$$

where n=index of refraction at the source of the ray
P=position vector
dP/ds=derivative of P with respect to arc length
Gradient of the index of refraction n=

$$\nabla n=\frac{\partial n}{\partial x}+\frac{\partial n}{\partial y}+\frac{\partial n}{\partial z}$$

Some remarkable lensing capabilities exist when the gradient is spherical, that is, when the gradient varies consistently from the core to the boundary of a spherical lens block. A particular spherical gradient was determined by Luneburg in the 1940s to be noteworthy. It is $$n=\sqrt{2-\left(\frac{r}{a}\right)^2}$$

where n=index of refraction
r=radius variable
a=radius of lens sphere.

This gradient drops parabolically from a peak value of the square root of two at the core to one at the edge. To acoustic rays it has a slow-speed core and is the same as water at the edge.

The unique characteristic of this lens is that, unlike a uniformly solid spherical lens that refracts rays to an unfocused caustic, the rays of a plane wave incident on a spherical Luneburg lens are focused to a point on the rear face of the lens. In addition, the rays have a consistent optical length, which is the integral of the product of the path length and the index of refraction. This implies that acoustic rays will arrive at the focus in phase. The sphere acts as a two-dimensional array with an aperture that is the diameter of the lens. It does so while using a single transducer and no beamforming electronics. The lens itself forms the same normal beam as an equivalently sized array of continuous sensors.

The gradient does not have to follow the Luneburg gradient to have valuable properties. The gradient can be made in a solid-body lens to cause the focus to fall behind the lens and/or to act on non-parallel wavefronts. In an active-transducer role, suitable for lithotriptic procedures that break up kidney stones inside a patient's body, a lens can accept the acoustic energy from a transducer and project it in a concentrating gradient to fall at a point focus some distance from the lens. This allows the rays to be focused inside the patient's body from outside.

Fixed spherical-gradient lenses have promise in many applications. However, for high-performance shipboard sonar systems, the fixed gradient is a handicap. It causes the lens to work only in the direction of the axis determined by the position of the transducer. Sonars used for searching and tracking require that beams be steered through wide angles of azimuth and elevation.

Array beamformers create beams by imposing suitable delays in signals from hydrophone spaced apart from each other. The sum of the delayed signals implies a beam steered to an angle off the axis of the array. Similarly, inverse beamformers create transmit beams by introducing appropriate delays into the active waveform sent to projectors. The effect is to create a plane wavefront from the array. The array can be a line, a two-dimensional curve, or a three-dimensional surface and still create the equivalent of a flat wavefront.

Sonar Arrays

The beam pattern of a typical acoustic array has a dominant main lobe caused by the effect of constructive interference of coherent waves. This pattern is evident as the received pattern for passive arrays and the outgoing power pattern (proportional to the square of the beam pattern) of the combined peaks of outgoing transmitted waves. The beam pattern appears to indicate that acoustic energy is confined to the beam when, in fact, energy (the time integral of the waveform) is far less directional than beam pattern implies.

Active waves from a typical shipboard transducer radiate omnidirectionally. When they are backed with a substantial baffle, as is standard, they produce a field that is hemispherical from the face of the projector. Each transducer pointing radially around cylindrical or spherical arrays sends its rays hemispherically, centered on the normal to its face. The waves from a half-aperture of an active array are timed to produce a flat wavefront in the desired direction. The wavefront is generated by coordinating the omnidirectional emissions from several transducers, whose normal directions are different in a cylindrical or spherical array. The energy in the pointed beam is at the cost of the energy "wasted" in all other directions of the hemisphere for each transducer.

Not only is the energy outside the beam wasted, it also is a problem to the receive process. The transmitted sonic energy in the sector outside the beam is the source of reverberation which is energy reflected from the sea surface, the ocean bottom and scatterers in the water volume. This reflected energy returns to the array and confuses the receiving process.

If the energy from the transducers can be directed more efficiently, then the two deficiencies of wide-angle ensonification can be overcome. The present invention does this. The lens is used to direct as much of the energy from each projector to the desired beam. Blocks of the lens in front of each transducer steer the energy to the desired direction. This allows the sonar to work with less energy to perform the equivalent function or the same amount of energy can make the sonar effectively more powerful in the beam. In addition, the amount of reverberation is reduced in proportion to the amount of energy not spread outside the working beam.

The steerable acoustic lens works in the receiving direction as well as for transmit. The lens can give each hydrophone an admittance beam that is similar to that of a large array. The effect is to present to the hydrophone signal and noise from a selected direction, rather than from the facing hemisphere. In simple terms, the lens will pass the signal-carrying beam to the hydrophone but most of the interfering noise from adjacent bearings will be excluded. The effect is to improve the signal-to-noise ratio in the lensed beam.

Time-Variable Acoustic Array Lens

The acoustic lens is only of substantial value if it can be used to enhance all the beams of an array. Two properties are required and electro-rheological fluids address them both:

a. Each transducer in the aperture needs a different lens effect. The one transducer that points in the direction of the beam needs a "straight-through" symmetrical lens. It gathers the energy from the transducer face and projects it all (or as much as feasible) into the beam. Every other projector needs some degree of lens asymmetry to get its projected energy redirected toward the working beam. The ability to tailor the lens effect for every transducer is possible by controlling the solidification field in sections that are on the order of a few percent of the width of the transducer face. The control apparatus can be implemented with a sufficient number of field electrodes in the lens block. Each electrode pair controls the bulk modulus (and the refractive index) of a small portion of the lens block. Adjustment of the voltage applied to each pair provides the necessary lens control.

b. An array must have all of its beam directions covered by equivalent lensing action. A fluid band in front of the transducer faces performs the same lensing function of varied beam angles by being steered. It is steered by changing the electrode voltages to adjust the gradient in front of each transducer to steer the lens to the appropriate direction. Electro-rheological fluids change state with time scales on the order of tens of microseconds. The lens action can be steered with its control voltage with the same scanning action used by the beamformer.

Solid acoustic lenses have been fabricated of wax in shapes similar to glass optical lenses. Gradient index acoustic lenses have been made of layers of materials with varying indeces of refraction. Electromagnetic lenses in electron microscopes use gradients of magnetic and electric fields to focus electron beams. The present invention is unlike all of these in that it uses an electric field to control the index of refraction in an electro-rheological acoustic lens.

BRIEF DESCRIPTION OF THE DRAWINGS

For a better understanding of the present invention and the advantages and novel features thereof, reference is made to the following descriptions to be used in connection with the accompanying drawing, in which.

GENERAL DESCRIPTION OF THE PREFERRED EMBODIMENT

Figure 1:
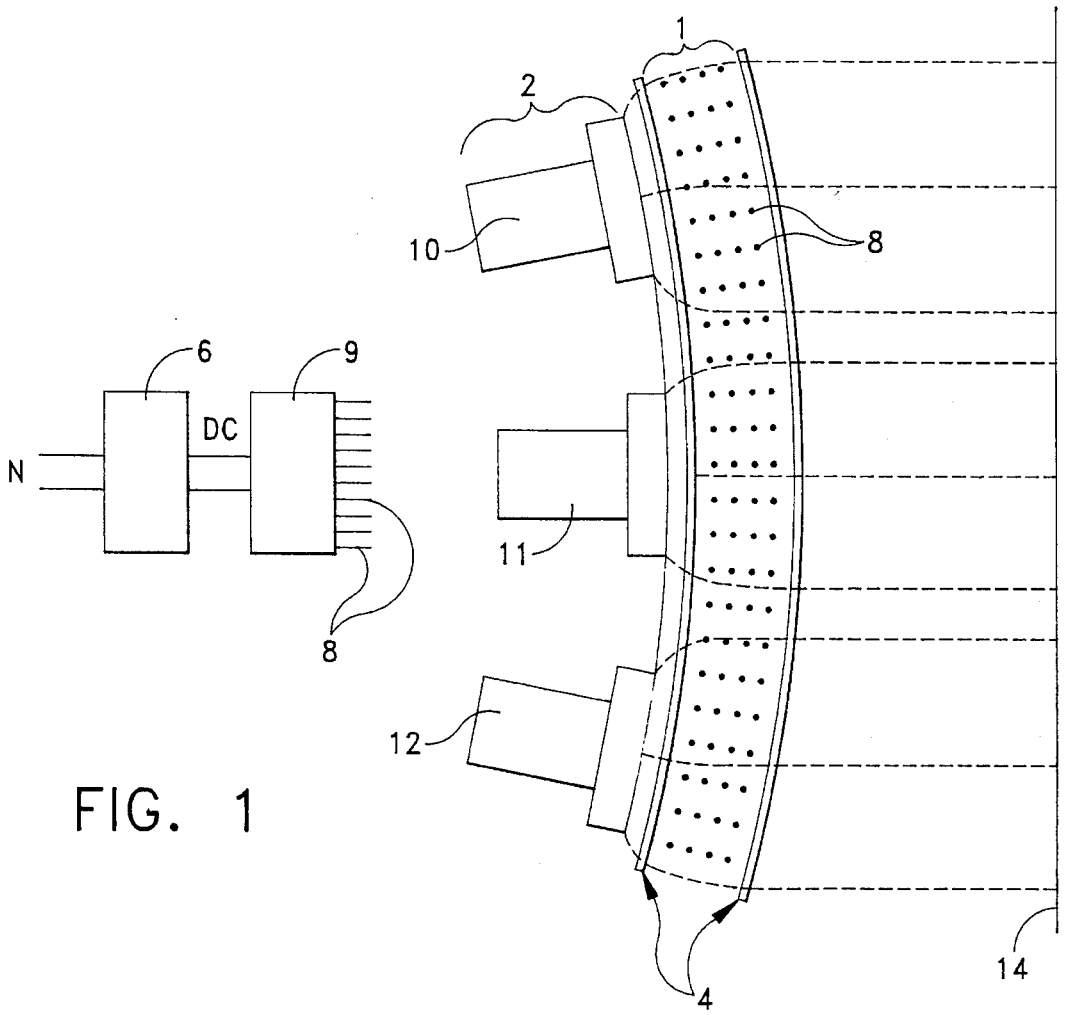
FIG. 1 illustrates in a diagrammatic manner, the embodiment of the present invention used to focus plane waves from different directions on array of transducers arranged in a circle.

Referring to FIG. 1, the time-variable acoustic lens is implemented as a band of fluid, 1 around the transducer array, 2. The oil-based fluid is held in a container, 4 that is made of a polymer that has the same acoustic impedance as water to prevent undesirable scattering. A variety of polymers such as polyphenylene oxide are available with the appropriate density and modulus of elasticity to perform the required function. Strength on the order of 5000 psi is typical without reinforcement in these polymers. The lens is controlled by a power supply, 6 that applies high voltage to the electrodes, 8 in the lens through a set of switching electronics 9. The switches, 9 apply a set of appropriate voltages on the electrodes in front of each transducer 10, 11, 12, causing the acoustic energy transmitted from each transducer to be bent as it transits the lens body toward the direction of the desired outgoing plane wave 14.

Figure 2:
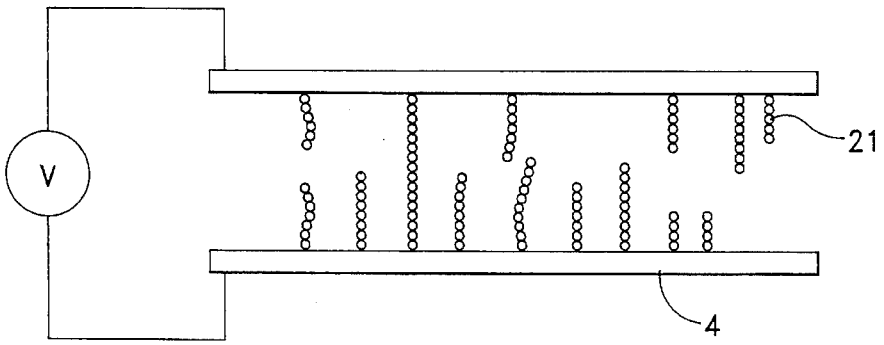
FIG. 2 shows how the semi-conductor particulate in the electro-rheological fluid line up in response to an electric voltage applied to opposing electrodes.

The key to operation of the lens is a unique attribute of electro-rheological fluids. The particulate matter is shown in FIG. 2 as items 21 suspended in the fluid. They tend to collect in strands as the electric field increases. The crystalline particulate has a modulus of elasticity that is very high and, when lined up, give the fluid an anisotropic bulk modulus. Just as composite materials are strong and stiff in the direction of reinforcing fibers, the electro-rheological lens has a bulk modulus that is high in the direction of the particulate strings. The particulate strings can be lined up in the desired direction by controlling the voltage on the electrodes.

Figure 3:
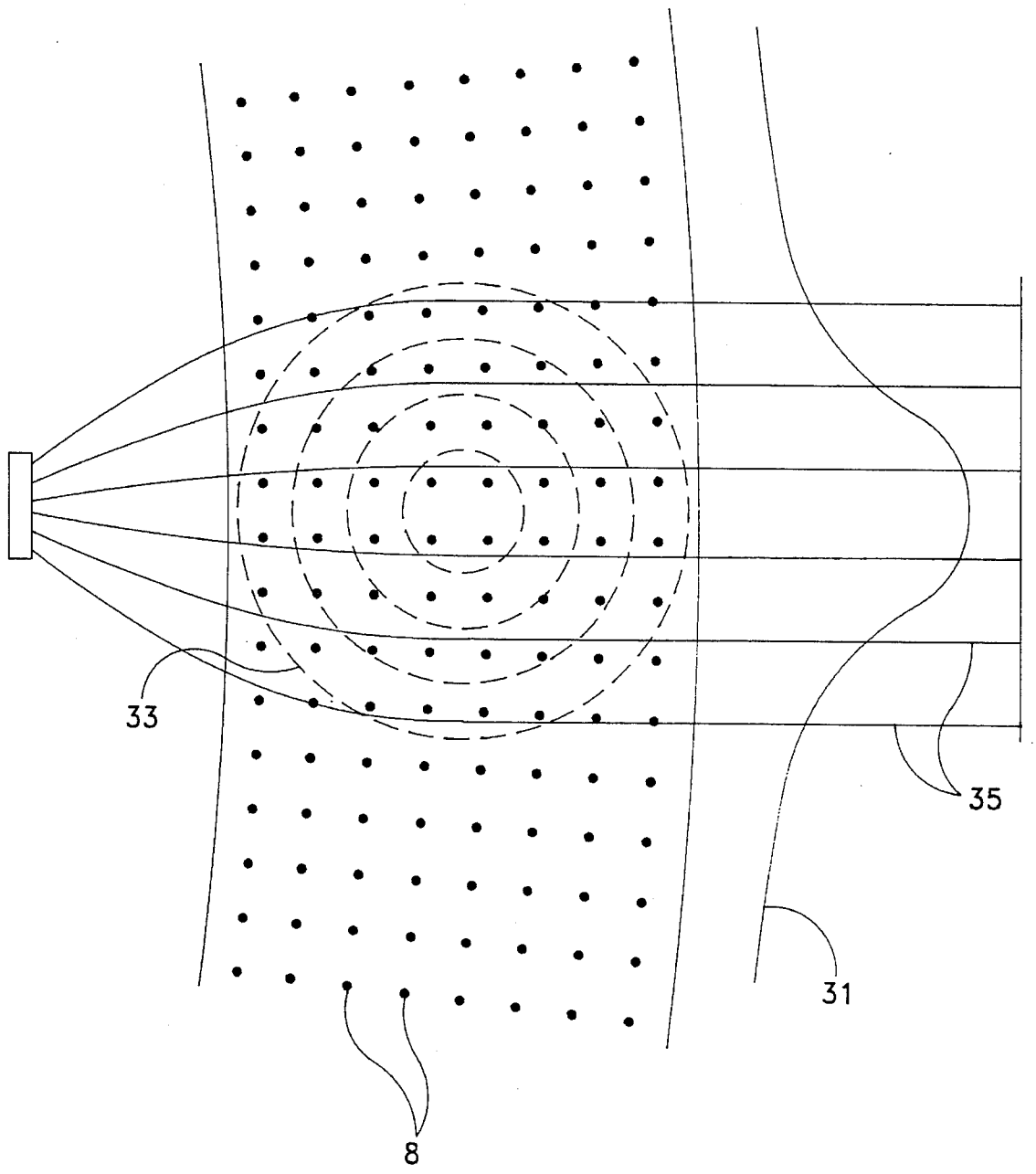
FIG. 3 illustrates the lensing effect of a radial gradient in a circular lens.

These electrodes do not have to be large plates; they can be wires in a three-dimensional array as illustrated in FIG. 3. This figure shows the electrodes 8 as an array of wires perpendicular to the page. The voltage impressed on adjacent electrodes is configured to produce the over-all gradient illustratively qualitatively by the curve 31. Near the core of the lens it has a high index of refraction. At the periphery, it is low and equal to the index of refraction of the surrounding water. The contours 33 show the mapping of the index of refraction that impose the required steering of acoustic rays 35.

DESCRIPTION OF ALTERNATIVE EMBODIMENTS

The steerable acoustic lens can be applied to several applications with varying geometries and ray paths. Several of these are illustrated in FIG. 4 through 10.

Figure 4:
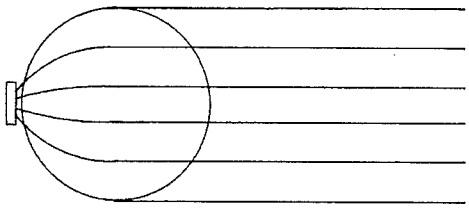
FIG. 4 through 10 illustrate a variety of applications of the lens.

FIG. 4 shows the simple Luneburg Lens configuration. It takes a flat wavefront and focuses it at a point on the surface of the lens. It has limited direct applications because the point focus makes transduction difficult.

Figure 5:
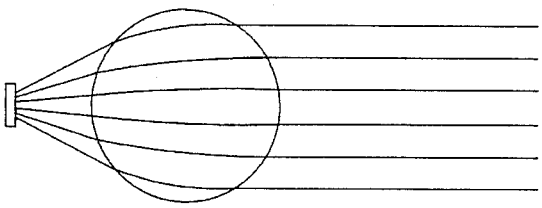

A slight modification of the gradient of the Luneburg lens gives the lens configuration of FIG. 5. Instead of a point focus on the lens surface, the focus is outside the lens and allows the rays to be intercepted on a transducer of finite extent. This is the configuration of lens that is applicable to fixed-direction devices. Applications as simple as fathometers can take advantage of the narrowing of the beam by the lens. This narrowing makes the power projection more efficient. The figure shows that acoustic energy radiating over approximately 60 degrees is focused into a uniform beam. The lens gives the effect of an aperture as wide as the lens and reduces detectability of its emissions to nearly that of a parametric sonar, without the complexity of the higher frequency electronics and with greater than the 1 percent efficiency of parametric sonars in getting the difference frequency generated.

Figure 6:
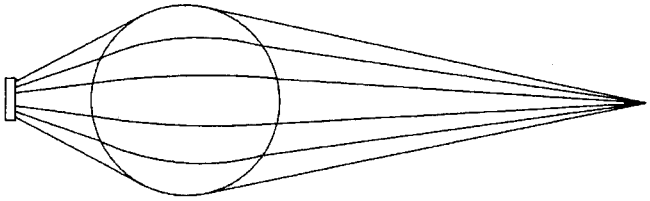

FIG. 6 shows that the lens can be used to focus the energy from a transducer to a point or to a caustic. This is the configuration that would be appropriate for lithotriptic devices to break up kidney stones.

Figure 7:
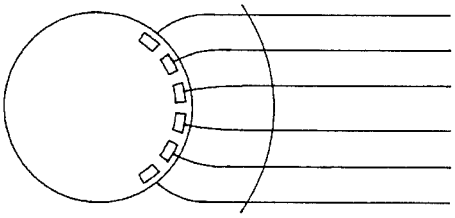

FIG. 7 illustrates the steerable lens in front of a cylindrical or spherical shipboard sonar array. The lens takes the incoming wavefront and bends it to strike the sensors of the aperture. It also works for transmit. The same inverse beamformers used today still are required, to get the wave timed to the direction of the beam, but more of the acoustic energy generated by the transducers is pointed in the direction of the working beam.

Figure 8:
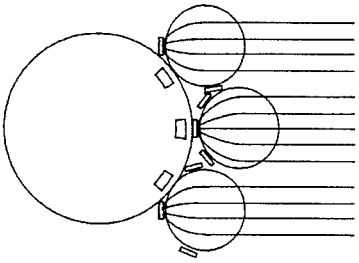

FIG. 8 shows the application of spherical lenses of the type illustrated in FIG. 5 in an array. Each lens works to provide a subarray to improve the directivity. Additionally using several transducers on each sphere allows an array to be made up of fewer transducers for equivalent performance. This makes the inboard processing load proportionally smaller and reduces the inboard footprint of the system.

Figure 9:
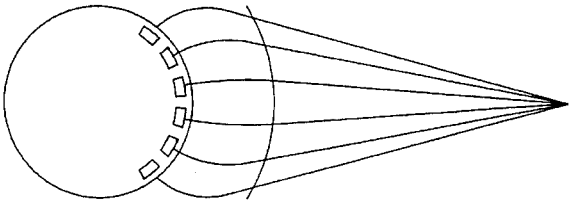

FIG. 9 illustrates the concept that the energy of an array can be focused to a point some, distance from the array. It is conceivable that, even when spherical spreading is considered, enough acoustic energy can be harnessed from the hundreds of kilowatts radiated by a shipboard sonar to be destructive.

Figure 10:
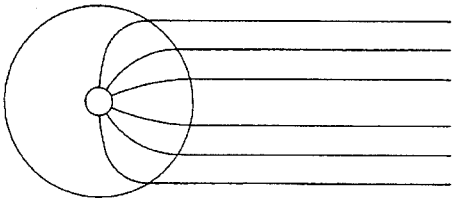

FIG. 10 takes the focusing of the steerable lens concept to its maximum extent. A single transducer is used at the core of a large lens block. The lens is steered to have rays pointed to or from the desired direction. The lens, by being as wide as the progenitor array, provides the same directivity as the array but has only one transducer. The inboard electronics serving the sensor has a single transducer channel plus the simple lens steering equipment. Because most of the transmitted energy in one hemisphere is directed to the working beam, the active portion is as effective as a large array.

What is claimed is:

1. An electrically steerable acoustic lens, comprising a mass of electro-rheological fluid, an array of electrodes within said mass, means of confining said mass of fluid around said array of electrodes, and means for applying electrical potential to said electrodes, the electrodes arranged such that when electrified, said electrified electrodes change the bulk modulus of said fluid so as to establish a gradient of the bulk modules in said mass.

2. The method of focussing acoustic energy to a very small area by means of an electrically steerable acoustic lens including a confined mass of electro-rheological fluid with an array of electrode wires, and a controllable power supply with switching devices to apply voltages to the electrodes that establish a desired gradient to the index of refraction comprising: applying an accoustical force to said lens while modifying said power supply so as to vary the index of refraction of said lens to the desired position.

3. The lens of claim 1 wherein said change of said bulk modulus of said fluid establishes a gradient of the index of refraction of said fluid.

4. The lens of claim 1, said means for applying electrical potential to said mass including a controllable power supply with switching devices to enable various voltages to be applied to said electrodes.

5. The lens of claim 1, said electro-rheological fluid being a mixture of a non-conducting mineral oil fluid with a suspension of semiconducting particles of alumino-silicate powder.

6. The method of steering acoustic energy by means of an electrically controlled acoustic lens including a confined mass of electro-rheological fluid with an array of electrodes and means for applying electrical potential to the electrodes so as to establish a gradient to the bulk modulus of said fluid comprising; applying acoustical wave energy to said lens while modifying the electrical potential to said electrodes so as to vary the bulk modulus of said fluid and thus establish a gradient of the bulk modulus of said fluid so as to steer said acoustic energy that is traversing said fluid.

7. The method of claim 6 wherein the means for applying electrical potential to the electrodes is a power supply and wherein the electrical potential to said electrodes is varied by changing the voltage out of said power supply.

* * * * *